US006206006B1

(12) United States Patent
Schütze et al.

(10) Patent No.: US 6,206,006 B1
(45) Date of Patent: Mar. 27, 2001

(54) MANUAL PACKING DEVICE FOR CIGARETTE TUBES, IN PARTICULAR CIGARETTE FILTER TUBES WITH A VARIABLE-LENGTH TOBACCO PACKING CHAMBER HAND FILLING DEVICE FOR CIGARETTE TUBES, PARTICULARLY FILTER CIGARETTE TUBES, WITH A TOBACCO PRESS CHAMBER VARIABLE IN LENGTH

(75) Inventors: Gunter Schütze; Klaus Gätschmann, both of Trossingen (DE)

(73) Assignee: EFKA-Werke Fritz Kiehn GmbH (DE)

( * ) Notice: Subject to any disclaimer, the term of this patent is extended or adjusted under 35 U.S.C. 154(b) by 0 days.

(21) Appl. No.: 09/091,147

(22) PCT Filed: Oct. 15, 1996

(86) PCT No.: PCT/EP96/04484

§ 371 Date: Sep. 14, 1998

§ 102(e) Date: Sep. 14, 1998

(87) PCT Pub. No.: WO97/20476

PCT Pub. Date: Jun. 12, 1997

(30) Foreign Application Priority Data

Dec. 4, 1995 (DE) ..... 195 45 190
Dec. 29, 1995 (DE) ..... 195 49 127

(51) Int. Cl.[7] ..... A24C 5/42; A24C 5/06
(52) U.S. Cl. ..... 131/70; 131/72
(58) Field of Search ..... 131/70, 71, 72

(56) References Cited

U.S. PATENT DOCUMENTS 5,398,701 * 3/1995 Neumann et al. ..... 131/70
5,450,861 * 9/1995 Colani ..... 131/70

* cited by examiner

*Primary Examiner*—Stanley S. Silverman
*Assistant Examiner*—Dionne A. Walls
(74) *Attorney, Agent, or Firm*—Andrus, Sceales, Starke & Sawall

(57) ABSTRACT

Hand filling device for cigarette tubes, particularly for filter cigarette tubes, with a tobacco press chamber extending in the longitudinal direction thereof, which is formed by a casing (12) located in the base portion (14), a press head (16) provided on a lid (18) covering the casing (12) and hinged to the casing (12), an ejector slide (22) for ejecting a tobacco skein pressed in a tobacco chamber via an opening (24) provided in the casing (12) into a (filter) cigarette tube, of a clamp device (59), which holds the (filter) cigarette tube in a clamping manner on a socket (50) located at the outlet of the tobacco press chamber, and of a resiliently-engaging, snap-in or the like device (60) for detachable connection of casing (12) and lid (18). In order to adapt the filling length of the tobacco chamber, there is associated with the ejector slide (22) an off-settable stop means (84), by means of which the tobacco filling position of the ejector slide (22) is alterable, adapting to the desired filling length of the tobacco press chamber.

11 Claims, 6 Drawing Sheets

Figure 1:
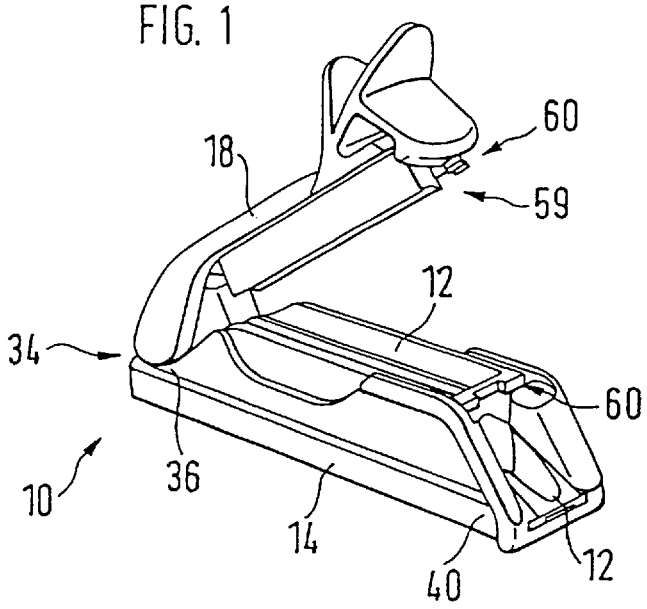

FIG. 13
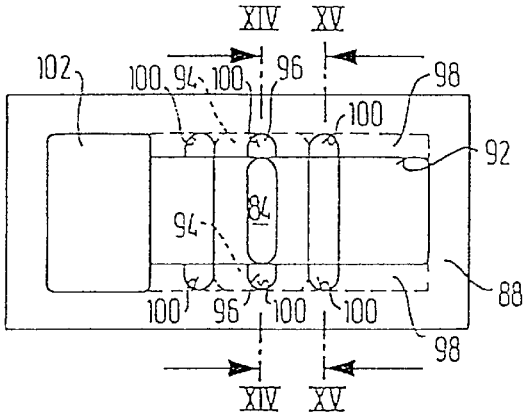
FIG. 14
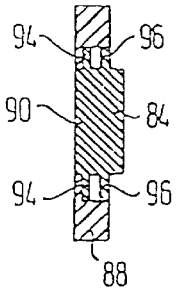
FIG. 15
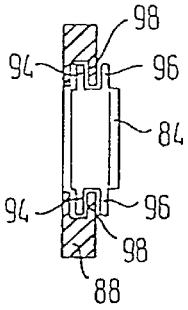
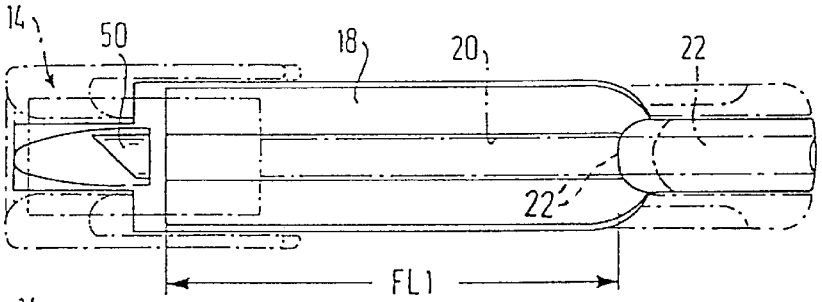
FIG. 16
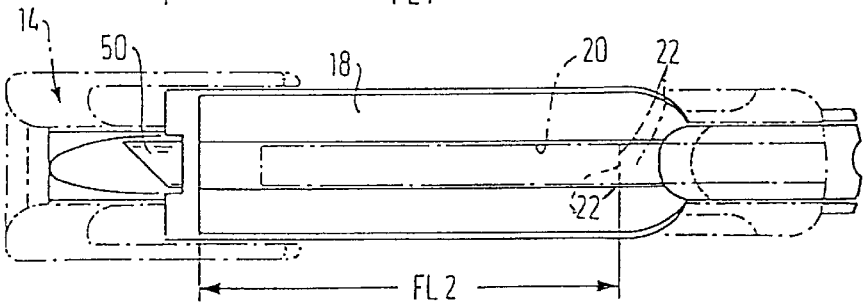
FIG. 17
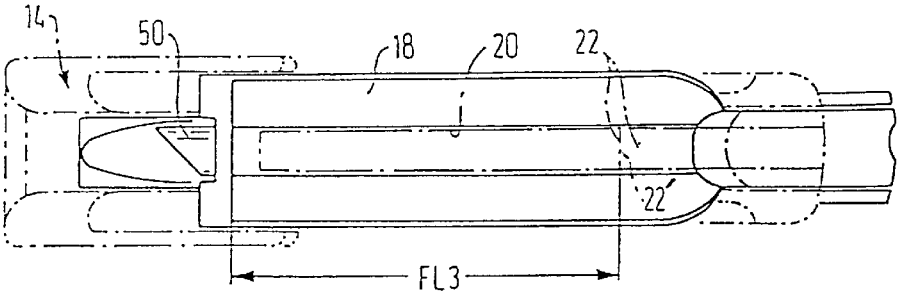
FIG. 18

MANUAL PACKING DEVICE FOR CIGARETTE TUBES, IN PARTICULAR CIGARETTE FILTER TUBES WITH A VARIABLE-LENGTH TOBACCO PACKING CHAMBER HAND FILLING DEVICE FOR CIGARETTE TUBES, PARTICULARLY FILTER CIGARETTE TUBES, WITH A TOBACCO PRESS CHAMBER VARIABLE IN LENGTH

The invention relates to a hand filling device for cigarette tubes, particularly for filter cigarette tubes with a tobacco press chamber extending in the longitudinal direction of the same, which is formed by a casing located in a base portion, a press head provided on the lid covering the casing and hinged to the lid, an ejector slide and if necessary a spoon connected therewith for ejecting a tobacco skein pressed in the tobacco press chamber out of said chamber, via an opening provided in the casing into a (filter) cigarette tube, of a clamp device , which holds the (filter) cigarette tube in a clamping manner on a socket located at the outlet of the tobacco press chamber, and of are silently-engaging, snap-in or the like device for detachable connection of casing and lid.

Such a hand filling device for cigarette tubes, particularly for filter cigarette tubes, with a tobacco press chamber extending in the longitudinal direction of the same, is known from DE-PS 2021738. The tobacco press chamber of this hand filling device is substantially formed by a casing located in the base portion, and a press head, which is provided on a lid covering the casing and hinged to the casing. Furthermore, the tobacco press chamber of this hand filling device is delimited by a spoon and by an ejector slide for ejecting a pressed tobacco skein out of the tobacco press chamber via an opening provided in the casing into a (filter) cigarette tube. This hand filling device also has a clamp device, which holds the (filter) cigarette tube in a clamping manner on a socket located at the outlet of the tobacco press chamber. Finally, this hand filling device also has a resiliently-engaging, snap-in or the like device for detachable connection of casing and lid, which has a substantially hook-shaped resiliently engaging nose connected to the free end of the lid opposite the hinge points between lid and casing, and located on a resilient elastic web, said nose being engageable with a resilient projection provided on the casing. Thus the resiliently engaging nose extends roughly in the direction of the hinge point between the lid and casing and the resiliently engaging projection roughly in the opposite direction thereto.

The similarly functioning hand filling device is also known from DE-4207196 A 1, this hand filling device involving a further development of the aforementioned device according to DE-PS 20 21 738. The further development relates to the already mentioned resiliently-engaging or snap-in device for detachable connection of casing and lid and to a particularly lightweight and yet stable construction of the device as a whole.

The object underlying the invention is to make available a hand filling device of the type named, the tobacco press chamber of which is adaptable to various lengths of prefabricated (filter) cigarette tubes, i.e. in particular to "king size" tubes on the one hand and "regular size" tubes on the other hand.

This object is achieved according to the invention by the characterising features of claim 1, constructive details of preferred embodiments being described in the sub-claims.

Thus the core of the present invention resides in the fact that measures are taken which permit adaptation of the filling length of the tobacco press chamber to the length of the tobacco receiving space of a prefabricated cigarette paper tube, particularly filter cigarette paper tube, to be filled, without the function of the hand filling device requiring to be otherwise altered. It is merely necessary to dispose a stop means in an off-settable fashion, by means of positioning of which the desired filling length of the tobacco press chamber may be determined.

In that the ejector slide is connected with a spoon, its length must be so selected that even at the minimum filling length of the tobacco press chamber it is still located within the same, i.e. does not project outwards through the opening provided in the casing. According to the invention, at least two different filling lengths of the tobacco press chamber may be adjusted, i.e. one for filling a "king size" tube and the other a "regular size" tube. Other adjustments however may be envisaged, insofar as corresponding tubes are available. By the filling length of the tobacco press chamber is meant the maximum length of the same when the ejector slide is fully retracted. In this position, the tobacco press chamber is filled with tobacco.

The present invention can also naturally be used for hand filling devices, e.g. for hand filling devices with a pivoting lever for actuating the ejector slide, wherein a rack passed about a gear wheel can be provided between the pivot lever and the ejector slide. In this case the stop means provided according to the invention may either be associated directly with the ejector slide or with the pivot lever, in such a way that the maximum retracted position of the ejector slide can be altered.

Accordingly, the filling length of the tobacco press chamber of course also changes.

Furthermore, it is irrelevant whether for purposes of filling the cigarette paper tube, the ejector slide is moved relative to the casing or the casing relative to the ejector slide. In both cases the tobacco filling position of the ejector slide is set by a stop means which may be either off-set on the casing relative to the ejector slide, or on the ejector slide relative to the casing.

Figure 2:
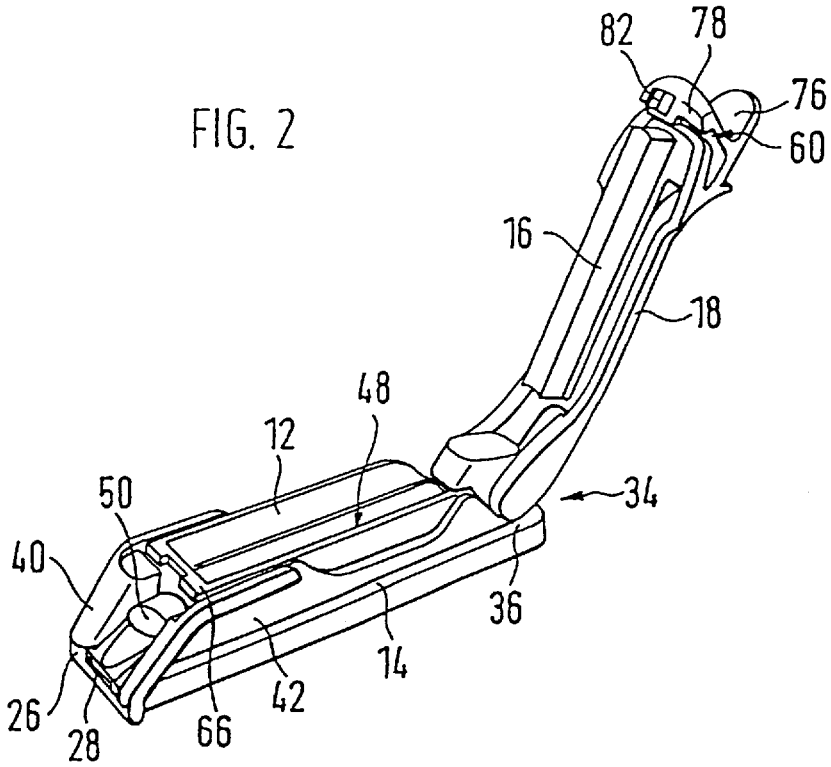
Figure 3:
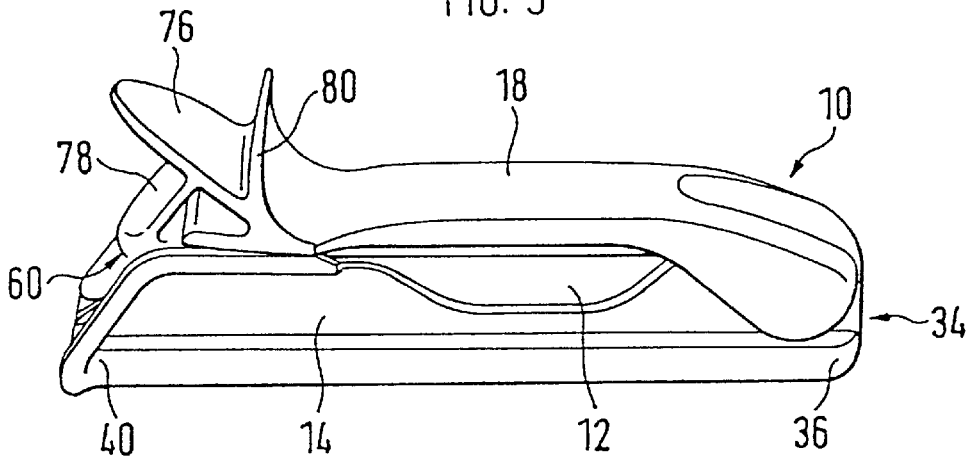
Figure 4:
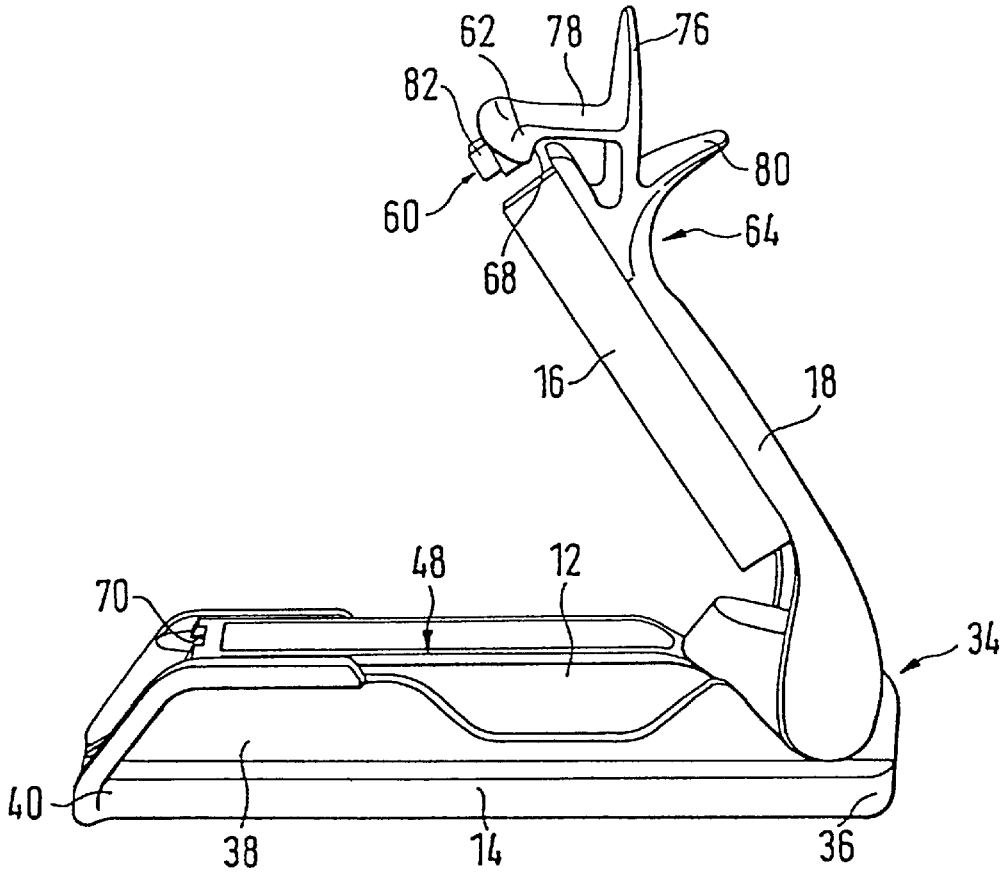
Figure 5:
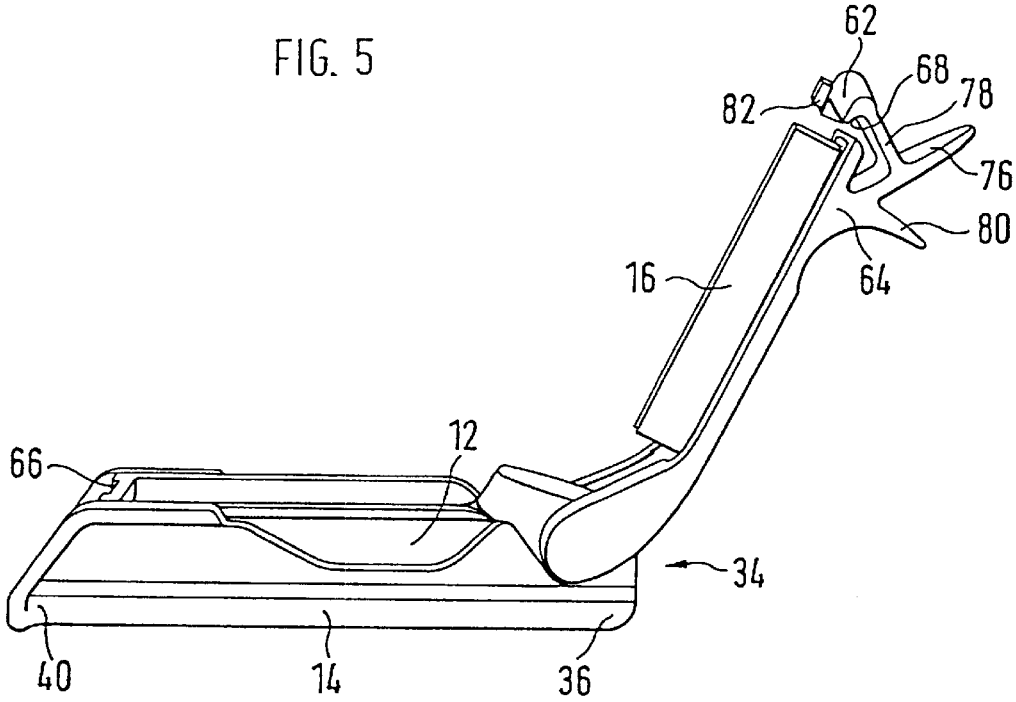
Figure 6:
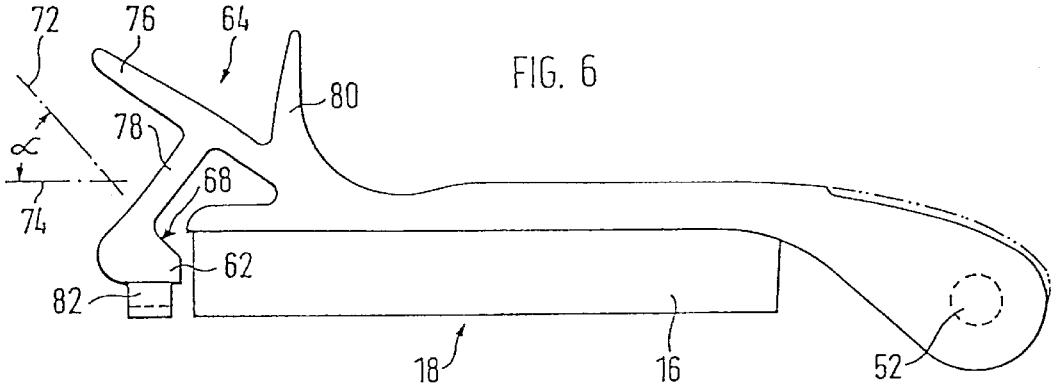
Figure 7:
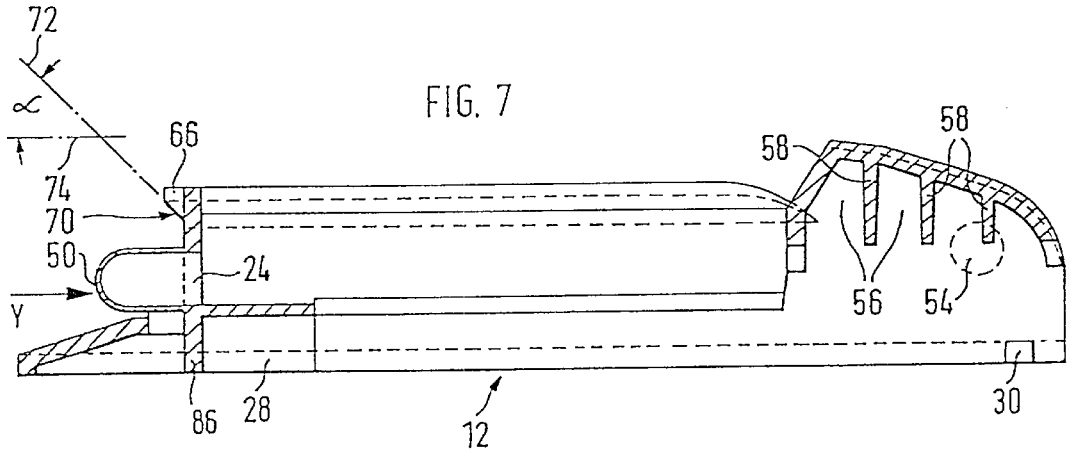
Figure 8:
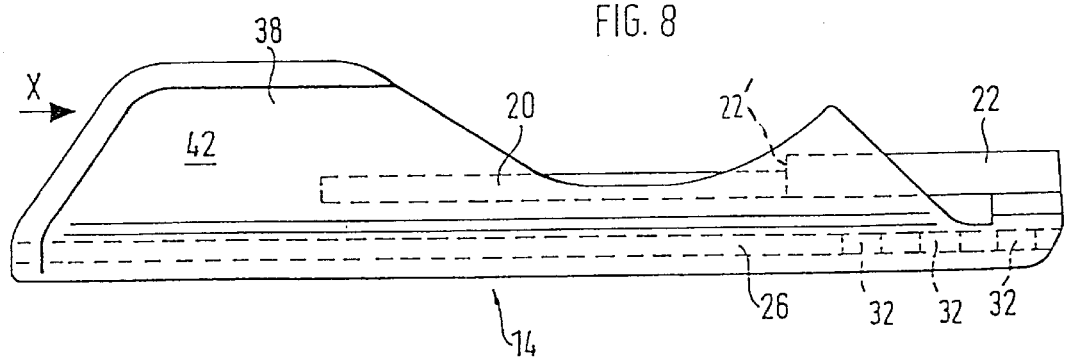
Figure 9:
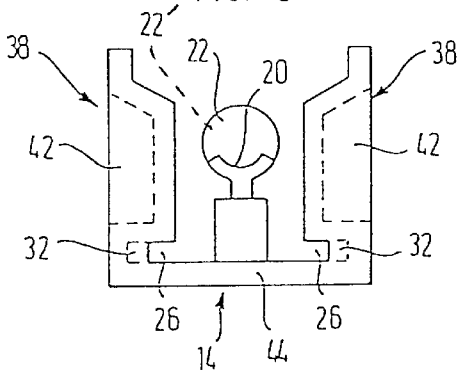
Figure 12:
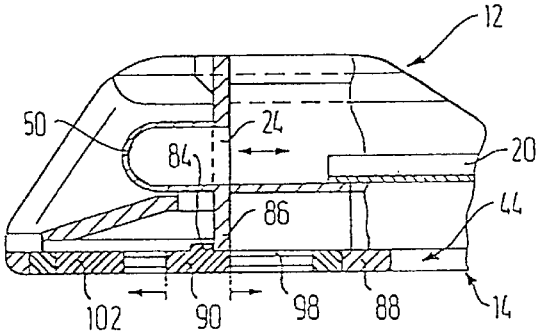
Figure 10:
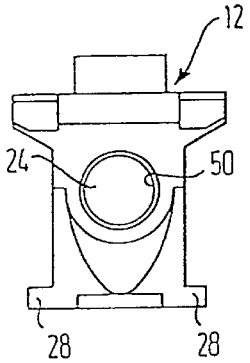
Figure 11:
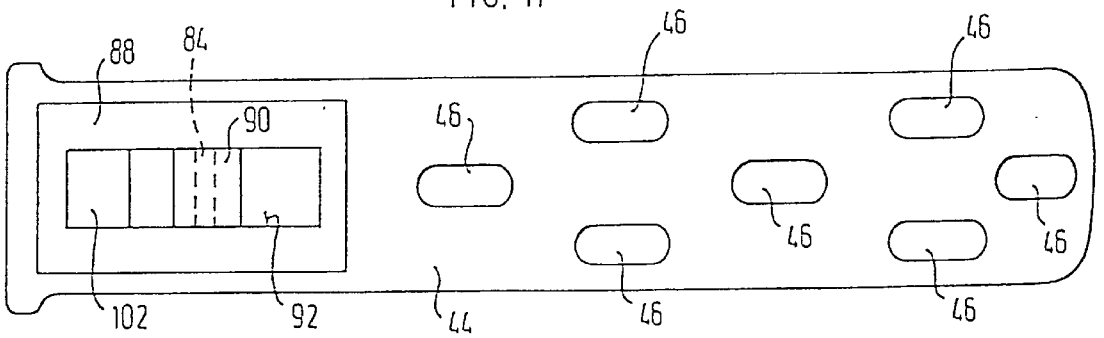

Further features, advantages and details of the invention will become apparent from the following description of a preferred embodiment of the invention, and with reference to the drawing, which shows:

FIG. 1: a perspective view of an embodiment of a hand filling device designed according to the invention, with partly opened lid;

FIG. 2: a perspective view of an embodiment of a hand filling device according to the invention, in accordance with FIG. 1, with the lid opened further;

FIG. 3: a perspective side view of an embodiment of a hand filling device according to the invention, according to FIGS. 1 and 2 with closed lid;

FIG. 4: a perspective side view of an embodiment of a hand filling device according to the invention, according to FIGS. 1 to 3, with the lid partly opened;

FIG. 5: a side view of an embodiment of a hand filling device according to the invention, according to FIGS. 1 to 4, with the lid further opened;

FIG. 6: a side view of an embodiment of a lid of the hand filling device according to FIGS. to 5 according to the invention in an enlarged view;

FIG. 7: a medial longitudinal section through an embodiment of a casing of the hand filling device according to the invention according to FIGS. 1 to 5 in an enlarged view;

FIG. 8: a side view of an embodiment of the base portion of the hand filling device according to the invention according to FIGS. 1 to 5 in an enlarged view;

FIG. 9: a front view of an embodiment of the base portion according to arrow X in FIG. 8;

FIG. 10: a front view of an embodiment of the casing according to arrow Y in FIG. 7;

FIG. 11: a view from below of an embodiment of the base portion according to FIG. 8;

FIG. 12: the portion on the side of the casing opening on the hand filling device according to the invention, in section, showing the relative position of casing and base portion in the tobacco filling position of the device;

FIG. 13: a stop means provided according to the invention for determining the filling position of the ejector slide and thus the filling length of the tobacco press chamber, which is integral in the base wall of the base portion according to FIG. 11, in plan view and on an enlarged scale;

FIG. 14: the stop means according to FIG. 13 in cross-section along line XIV—XIV in FIG. 13;

FIG. 15: the stop means according to FIG. 13 in cross-section along line XV—XV in FIG. 13;

FIG. 16: the hand filling device according to the invention in plan view showing a first filling position of the ejector slide relative to the casing;

FIG. 17: the hand filling device according to the invention in plan view showing a second filling position of the ejector slide relative to the casing;

FIG. 18: the hand filling device in plan view showing a third filling position of the ejector slide relative to the casing.

FIGS. 1 to 5 show a hand filling device 10 designed according to the invention for cigarette tubes (not shown), particularly for filter cigarette tubes (not shown), with a tobacco press chamber extending in the longitudinal direction of the hand filling device. The tobacco press chamber is formed by a casing 12, which is longitudinally movably located in a base portion 14. Further, the tobacco press chamber is delimited by a press head 16, which is provided on a lid 18 covering the casing 12 and hinged to the casing 12. In addition, the tobacco press chamber is determined by a spoon 20, and by an ejector slide 22 for ejecting a pressed tobacco skein from the tobacco press chamber via an opening 24 provided in the casing 12 into a (filter) cigarette tube. In this case the ejector slide 22, which is attached to the base portion 14, carries the spoon 20. The slide 22 is enlarged as shown in FIGS. 8 and 9 with a back end wall 22' between the enlarged portion and the spoon 20.

The base portion 14, which is roughly U-shaped in cross-section (see in particular FIG. 9) has two undercuts 26 for accommodating two correspondingly shaped guide rails 28 of the casing 12. In this way the casing 12 is movable to and fro only in the longitudinal direction of the hand filling device 10, in the base portion 14.

According to FIGS. 7,8 and 9 however there is provided between the base portion 14 and the casing 12 longitudinally accommodated by the base portion 14, a resiliently engaging or the like device, which causes a certain difficulty of movement at the beginning of the actual filling process in the longitudinal displacement of the casing 12 in the base portion 14. In this way involuntary release of the casing 12 from the base portion 14 is reliably avoided. The resiliently engaging device in this case consists of at least one lateral projection 30 on at least one of the two guide rails 28 of the casing 12, which is received by the undercut 26, regarded as a guide means, of the base portion 14. More advantageously however the lateral projection, attached at least to one of the two guide rails 28 of the casing 12, may be resiliently engaged into a lateral recess 32, adapted thereto, in the undercut or undercuts 26 regarded as a guide means, of the base portion. In the present case there are associated with the projection 30 three recesses 32, which are formed at axial intervals from one another on the undercut 26. These recesses 32 correspond to different relative positions between the casing 12 on the one hand and the base portion 14 together with the ejector slide 22 on the other hand, these different relative positions being determined by a stop means located in an off-settable manner in the base wall 44 of the base portion 14. In the embodiment shown, the projection 30 on the guide rail 28 of the casing 12 and the recesses 32 in the undercut 26 of the base portion 14 are attached in the area of the end 36 of lid 18 or base portion 14 close to the hinge point 32 between lid 18 and casing 12.

Furthermore, the two side walls 38 of the base portion 14, formed in a U-shape in cross-section, in the area of the end 40 of the base portion 14 opposite the hinge point 34 between lid 18 and casing 12 are provided with grasping recesses 42 or the like. The grasping recesses 42 offer a secure hold, particularly to the thumb and to the first finger of the user during the actual filling procedure, i.e. during longitudinal movement of the casing 12 with the lid 18 hinged thereon within the base portion 14. Slippage during the actual filling procedure is thus eliminated.

As shown in FIG. 11, recesses 46 are provided in the base wall 44 connecting the two side walls 38 of the base portion 14 together, in order to save material and thus to reduce the weight of the hand filling device 10 as a whole. The ejector slide 22 carrying the spoon 20 is mounted according to FIG. 8 in the area of the end 36 of the base portion 14 close to the hinge point 34 between lid 18 and casing 12.

For filling tobacco into the tobacco press chamber, the casing 12 has a filling opening 48, and for ejecting the pressed tobacco skein from the tobacco chamber, an opening 24, which connects with a socket 50. The socket 50 serves to accommodate the (filter) cigarette tube about to be filled with tobacco. Opening 24 and socket 50 are disposed in the area of the end 40 of the base 14 opposite the hinge point 34 between lid 18 and casing 12. Hinged connection of the lid 18 to the casing 12 is effected in this case by means of two circular projections 52, extending laterally outwards, on the lid 18, and which engage in bores 54 of corresponding size on the casing 12. The casing 12 has apertures 56 in the material, preferably in the area of the hinge point 34, in order further to reduce the weight of the hand filling device 10. Reinforcement ribs 58 simultaneously provide a high degree of stability and strength of the hand filling device 10.

Furthermore, the hand filling device 10 comprises a clamp device 59, which holds the cigarette tube in a clamping manner on the socket 50 located at the output of the tobacco press chamber, and a resiliently-engaging, snap-in or the like device for detachable connection of casing 12 and lid 18. The resiliently-engaging, snap-in or the like device 60 has a resiliently-engaging nose 62, which is located at the free end 64 of the lid 18 opposite the hinge point 34 between lid 18 and casing 12, and may be brought into engagement with a resiliently engaging projection 66 provided on the casing 12. The resiliently-engaging nose 62 and the resiliently-engaging projection 66 are substantially hook-shaped, the nose 62 extending roughly in the direction of the hinge point 34 between lid 18 and casing 12, and the projection 66 roughly in the opposite direction. The resilient nose 62 and resilient projection 66 come into contact when mutually operated via resiliently-engaging surfaces 68,70. The two resiliently-engaging surfaces 68,70 of nose 62 or projection 66 lie in a plane 72 standing vertically to the plane of the page, the horizontal plane 74 standing vertical to the plane of the page intersecting at an angle $\alpha$ of 15° to 75°, particularly at an angle $\alpha$ of 45°, as can be seen in detail from FIGS. 6 and 7.

Instead of the resiliently-engaging projection 66, an engagement recess (not shown) can be provided for accommodating the resiliently-engaging nose 62. The nose 62 is located in a resilient elastic web 78, which is in turn connected via a further resilient elastic web 76 to the free end 64 of the lid 18. Finally, an additional upwardly projecting actuation web 80 is integrally moulded on the free end of the lid 18. The function of the aforementioned webs and resiliently-engaging or snap-in device is described in detail in DE-4207196 A 1, to which reference is made.

The clamp device 59 consists of a clamp piece 82, which upon operation of the resiliently-engaging or snap-in device 60 comes into close contact on the socket 50. The (filter) cigarette tube is in this way automatically clamped securely on the socket 50, and during the entire actual filling procedure, i.e. during the entire ejection movement of the tobacco from the tobacco press chamber. The clamp piece 82 is preferably resiliently elastic, and in particular made of soft plastic, rubber or the like.

The particular feature of the hand filling device described resides in the fact that, as FIGS. 11 to 18 show in particular, a stop means 84 for fixing the tobacco filling position of the ejector slide 22 relative to the casing 12 is integrated in the base wall 44 of the base portion 14. This stop means 84 is disposed in a direction parallel to the ejection direction of the tobacco in an off-settable way so that the filling length of the tobacco press chamber can be correspondingly varied. For this purpose the said stop means 84 corresponds with the lower edge 86 of the forward end wall, comprising the tobacco ejection opening 24, of the casing 12 mounted to be displaceable relative to the base portion 14, as can be well seen in FIG. 12.

The stop means 84 in the embodiment shown is in the form of a transverse web, i.e. as a web transversely to the direction of ejection of the tobacco and roughly parallel to the base wall 44 of the base portion 14.

In particular, the said transverse web is off-settably located within a separately insertable base wall insert portion 88 in the base wall 44 of the base portion 14, off-settable from a normal position corresponding to FIG. 16 in which the filling length of the tobacco press chamber is maximum (e.g. for filling a king size cigarette tube) into at least one, here two different positions corresponding to FIGS. 17 and 18, in which the filling length of the tobacco press chamber is respectively reduced. The different filling lengths of the tobacco press chamber are indicated by FL1, FL2 and FL3 in FIGS. 16 to 18.

In FIG. 11 and FIG. 13 the stop means or the transverse web 84 defining it, is located in a central position, which corresponds to the relative position between casing 12 and base portion 14 as per FIG. 17. In the normal position, for filling a king size cigarette paper tube, the transverse web 84 in FIG. 18 is off-set to the left. In order to fill an extremely short cigarette paper tube, the transverse web 84 in FIG. 13 is off-set to the right. The two last-named positions correspond to the relative positions shown in FIGS. 16 or 18 of the base portion 14 together with the ejector slide 22 on the one hand and the casing 12 along with the lid 18 on the other hand.

As can be seen from FIGS. 12 and 14, the transverse web 84 is an integral part of a plate-like element 90, which is longitudinally movably mounted within a roughly rectangular aperture 92 of the separate base wall insert portion 80 and, as here, is variously engageable at three predetermined points. The plate-like element 90 has on its flat sides associated with the end sides of the transverse web 84, a respective longitudinal web 94, and at a spacing thereabove, a nose-like projection 96, between which a respective complementary longitudinal web 98 extends through within the aperture 92 in the base wall insert portion 18 for purposes of longitudinal displacement of the plate-like element 90. These longitudinal webs 98 have apertures 100 located at an axial spacing apart, corresponding to the nose-like projections 96, into which the said nose-like projections 96 of the plate-like element 90 may be resiliently engaged. For this purpose, in one of the three resiliently engaged positions of the plate-like element 90 shown in FIG. 13, this latter is pressed downwards in accordance with FIG. 14, so that the nose-like projections 96 come into engagement with the complementary apertures 100. If the plate-like element 90 is to be off-set together with the transverse web 84, the plate-like element 90 must be pressed upwards in accordance with FIG. 15, until the nose-like projections 96 disengage from the complementary apertures 100. Then the plate-like element 90 can be moved along the longitudinal webs 98 until another desired resiliently engaged position is reached.

In order to be able to insert the plate-like element 90 comprising the transverse web 84 into the aperture 90 in such a way that the described correspondence with the longitudinal webs 98 can be produced, the aperture 92 in the base wall insert portion 88 has an opening free of longitudinal webs, through which the plate-like element 90 can be inserted in the way described. After insertion of the plate-like element 90, the said opening is again closed. This closure is identified in FIGS. 11,12 and 13 by the reference number 102. The base wall insert portion 88 is formed in the manner of a rectangular frame. The closure 102 is formed by a closure plate, which is glued fast after assembly of the plate-like element 90. Then there is a secure gluing of the base wall insert portion 88 in the base wall 44. Basically it may also be envisaged that the base wall 44 is so formed that it has all the features of the described base wall insert portion 88. This embodiment is intended to be covered by the protection. It should however be noted that in terms of manufacturing technology the last-named embodiment is slightly more expensive, because it is simpler to manufacture the separate base wall insert part and to integrate it in the base wall 44 as shown in FIGS. 11 and 12.

As already stated in the introduction, there are also hand filling devices in which the ejector slide is displaceable relative to the casing of the hand filling appliance by means of a separate handle. In this case the casing has the aforementioned stop in association with the ejector slide in such a way that the ejector slide can be moved backed different distances for filling the tobacco press chamber with tobacco. In an appliance with a pivot lever for actuating the ejector slide, the stop means can also be associated with the pivot lever. In every case what is involved is a stop means which is off-settable as regards position, so that varying filling lengths of the tobacco press chamber can be adjusted.

Basically, a variable alteration in the position of the said stop means might be envisaged; in this case the stop means must be provided with a clamping mechanism, so that it can be secured in any optional relative position.

Basically, here also a hand filling device for cigarette tubes, particularly filter cigarette tubes, is placed under protection, which have a tobacco press chamber extending in the longitudinal direction of the said tubes, there being associated with this tobacco press chamber a press head and an ejector slide for ejecting a tobacco skein pressed in the tobacco press chamber out of said chamber into a (filter) cigarette tube. The tobacco filling position is established by an off-settable stop means, this stop means, as mentioned above, co-operating either directly with the ejector slide or indirectly with its actuating device. This stop means causes fixing of the maximum retraction of the ejector slide into its filling position, so that the filling length of the tobacco press chamber may be correspondingly altered. The delimitation of the ejecting movement of the ejector slide is however fixed so that no alterations need be undertaken in this respect.

All the features disclosed in the Application Documents are claimed as essential to the invention, insofar as they are new either individually or in combination in comparison to prior art.

What is claimed is:

1. A hand filling device for filling cigarette tubes including filter cigarette tubes with a tobacco skein, comprising a sliding casing (12) and a base portion (14) forming a tobacco press chamber extending in a longitudinal direction and including a fixed ejector slide (22) in said chamber with a back end wall (22') and aligned with a forward end opening (24) of said sliding casing, a discharge socket (50) at said end opening (24), a lid (18) covering said casing (12) and hinged to the casing, a press head (16) attached to said lid and movable into said press chamber, said casing (12) being slidably mounted in said base portion and movable in said base portion relative to said ejector slide (22) for ejecting a tobacco skein pressed into said tobacco press chamber from said tobacco press chamber through said end opening (24) and socket (50) into a cigarette tube, a clamp device (59) for holding a cigarette tube to said socket (5), and an off-settable stop means (84) located in the path of said slide casing (12) relative to said base portion and thereby controlling the tobacco filling portion of said press chamber whereby the size of said portion (FL1, FL2, FL3) of the tobacco press chamber is directly adjusted by off-setting of said stop means relative to the path of said slide casing (12).

2. The device of claim 1, wherein said stop means (84) is a transfer web (84) located in said chamber and is settable in a direction parallel to the direction of ejection of the tobacco skein.

3. The device of claim 2, wherein said transfer web is located within said base portion (14) includes a base wall (44) base wall insert portion being separately insertable into said base wall (44), and said transverse web located in said base wall portion.

4. The device of claim 3, wherein said transverse web is offsettable from a first position forming a first filling length (FL1) into at least one different position forming a second and lesser filling length (FL2, FL3).

5. The device according to claim 3, including a plate-like element (90), said transverse web being integrally connected to said plate-like element, said base wall in such portion (88) including a generally rectangular and longitudinal aperture (92), said plate-like element (90) movably mounted in said generally rectangular aperture (92) and being resiliently engageable therein to an immovably predetermined location.

6. The device of claim 5, wherein said plate-like element (90) has flat parallel sides and each of said sides includes a web (98), each side of said transfer web (84) includes a longitudinal web (94) and spaced parallel projections (96) with a space therebetween, said longitudinal webs (98) having apertures (100) located at axially interval spacings, said projections (96) of said plate-like element configured for resilient engagement with said apertures (100) for establishing the axial position of the plate-like element (90) within said aperture (92) in said base wall portion (88).

7. The device of claim 6, wherein said aperture (92) includes a thrust opening configured for insertion of said plate-like element (90), and a closure element (102) for closing said thrust end opening.

8. A hand filling device for filling cigarette tubes including filter cigarette tubes with a tobacco skein, comprising a tobacco press chamber extending in a longitudinal direction and having a fixed ejector slide (22) including a chamber back end wall (22')and a base wall and said press chamber having a forward discharge opening aligned with said ejector slide, a sliding casing slidably mounted in a base portion (14) and having a socket (5) configured and constructed to support a tobacco skein aligned with said press chamber and said ejector slide, a press head connected to the chamber for pressing a tobacco skein into said chamber, said ejector slide (22) injecting the tobacco skein pressed into the tobacco press chamber skein in response to moving said sliding casing, and including an offsettable stop means (84) located in the path of said sliding casing, said stop means being movable and offset from the discharge opening of said chamber and defining a limit for maximum retraction of the said casing relative to said ejector slide (22) and thereby defining the tobacco filling position and portion of the chamber whereby the filling length (FL1, FL2, FL3) of the tobacco press chamber is adjustable by the offset of said stop means.

9. The device according to claim 8, wherein said offsettable stop means is coupled to said ejector slide for limiting its maximum retraction.

10. The device of claim 8, wherein said press head includes a single press head configured for use with all setting of the stop means.

11. The device of claim 8 wherein said press head includes a single press head operable in all settings of said offsettable stop means.

* * * * *

UNITED STATES PATENT AND TRADEMARK OFFICE

CERTIFICATE OF CORRECTION

PATENT NO. : 6,206,006 B1
DATED : March 26, 2001
INVENTOR(S) : Gunter Schütze et al.

It is certified that error appears in the above-identified patent and that said Letters Patent is hereby corrected as shown below:

Title page, Item [54] and Column 1, lines 5-9,
Title, delete "HAND FILLING DEVICE FOR CIGARETTE TUBES, PARTICULARLY FILTER CIGARETTE TUBES, WITH A TOBACCO PRESS CHAMBER VARIABLE IN LENGTH"

Signed and Sealed this

Eighteenth Day of June, 2002

*Attest:*

*Attesting Officer*

JAMES E. ROGAN
*Director of the United States Patent and Trademark Office*